US005632104A

United States Patent [19]

Zohar

[11] Patent Number: 5,632,104

[45] Date of Patent: May 27, 1997

[54] SHOES FOR REDUCING STRESS IN FEET

[76] Inventor: Itzchak Zohar, 27 Jabotinsky Street, Holon, Israel, 58277

[21] Appl. No.: 407,736

[22] Filed: Mar. 20, 1995

[30] Foreign Application Priority Data

Oct. 4, 1994 [IT] Italy ..... 111172

[51] Int. Cl.[6] ..... A43B 13/14; A43B 7/14

[52] U.S. Cl. ..... 36/88; 36/94; 36/103; 36/25 R; 36/140

[58] Field of Search ..... 36/88, 93, 94, 36/103, 25 R, 140, 169, 142, 143, 144

[56] References Cited

U.S. PATENT DOCUMENTS

| | | | |
|---|---|---|---|
| 1,444,747 | 2/1923 | McNulty | 36/140 |
| 1,958,097 | 5/1934 | Shaw | 36/144 |
| 2,052,115 | 8/1936 | Shulman . | |
| 2,217,990 | 10/1940 | Nussbaum | 36/140 |
| 2,415,580 | 2/1947 | Davis | 36/88 |
| 3,305,947 | 2/1967 | Kalsoy | 36/144 |
| 3,673,623 | 7/1972 | Zohar | 12/133 R |
| 4,240,214 | 12/1980 | Sigle et al. | 36/43 |
| 4,266,553 | 5/1981 | Faiella | 36/144 |
| 4,620,376 | 11/1986 | Talarico, II . | |

FOREIGN PATENT DOCUMENTS

| | | | |
|---|---|---|---|
| 2396524 | 2/1979 | France . | |
| 1146406 | 3/1963 | Germany . | |
| 94491 | 5/1990 | Israel . | |
| 8304166 | 12/1983 | WIPO | 36/103 |

*Primary Examiner*—M. D. Patterson

*Attorney, Agent, or Firm*—Panitch Schwarze Jacobs & Nadel, P.C.

[57] ABSTRACT

A shoe including an upper and a sole portion and defining a foot support surface interior of the shoe and an engagement surface exterior of the shoe, the foot support surface being shaped to align the hindfoot in varus with respect to the tibia axis.

3 Claims, 6 Drawing Sheets

SHOES FOR REDUCING STRESS IN FEET

FIELD OF THE INVENTION

The present invention relates to shoes generally and more particularly but not exclusively to orthopedic shoes.

BACKGROUND OF THE INVENTION

Although the general construction and techniques of manufacturing shoes has not changed substantially over hundreds of years, various types of shoe structures are known in the art. Applicant's prior art U.S. Pat. No. 3,673,623 describes a shoe last design which has significant orthopedic effects. Applicant's prior art Israel Patent 94491 describes a footwear set employing three different orthotics which can be used with shoes built according to U.S. Pat. No. 3,673,623.

SUMMARY OF THE INVENTION

The present invention seeks to provide an improved shoe structure which has been scientifically shown to reduce tibial strains on subjects wearing such shoes for walking.

There is thus provided in accordance with a preferred embodiment of the present invention a shoe comprising an upper and a sole portion and defining a foot support surface interior of the shoe and an engagement surface exterior of the shoe, the foot support surface being shaped to align the hindfoot in varus with respect to the tibia axis.

Preferably the foot support surface defines a metatarsal line approximately at a location separated from the back of the shoe by a distance equal to two-thirds of the length of the shoe, the heel region of the foot support surface exhibiting a generally symmetric curve in planes parallel to the metatarsal line, and fitting the natural curve of the heel. In the specification and claims, the term "metatarsal line" is defined as a line on the structure of the foot support surface corresponding to and substantially underneath the imaginary line on the foot sole connecting the metatarsal heads at the joints with the phalanges.

There is also provided in accordance with a preferred embodiment of the present invention a shoe comprising an upper and a sole portion and defining a foot support surface interior of the shoe and an engagement surface exterior of the shoe, a metatarsal line being defined in the shoe approximately at a location separated from the back of the shoe by a distance equal to two-thirds of the length of the shoe, the foot support surface being curved at the metatarsal line to align the forefoot in valgus with respect to the tibia axis.

Additionally in accordance with a preferred embodiment of the present invention, there is provided a shoe comprising an upper and a sole portion and defining a foot support surface interior of the shoe and an engagement surface exterior of the shoe, a metatarsal line being defined in the shoe approximately at a location separated from the back of the shoe by a distance equal to two-thirds of the length of the shoe, and wherein the shoe is configured to define a load line on the structure of the foot support surface rearward of the metatarsal line, preferably by approximately one centimeter.

Further in accordance with a preferred embodiment of the present invention, the foot support surface is shaped to allow the toes to plantarflex and dorsiflex.

Preferably, a shoe is provided having more than one and most preferably all of the foregoing features.

In accordance with a preferred embodiment of the present invention, the engagement surface of the shoe is generally flat.

Additionally in accordance with a preferred embodiment of the present invention, the curved foot support surface is defined by the shoe sole rather than by an insert.

Further in accordance with a preferred embodiment of the present invention, multiple orthotic inserts may be provided to adapt a standardized shoe of the construction described hereinabove to individual foot configurations. Preferably up to 5 different orthotic inserts may be provided with a shoe, to enable a wearer to select the insert which is most comfortable.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
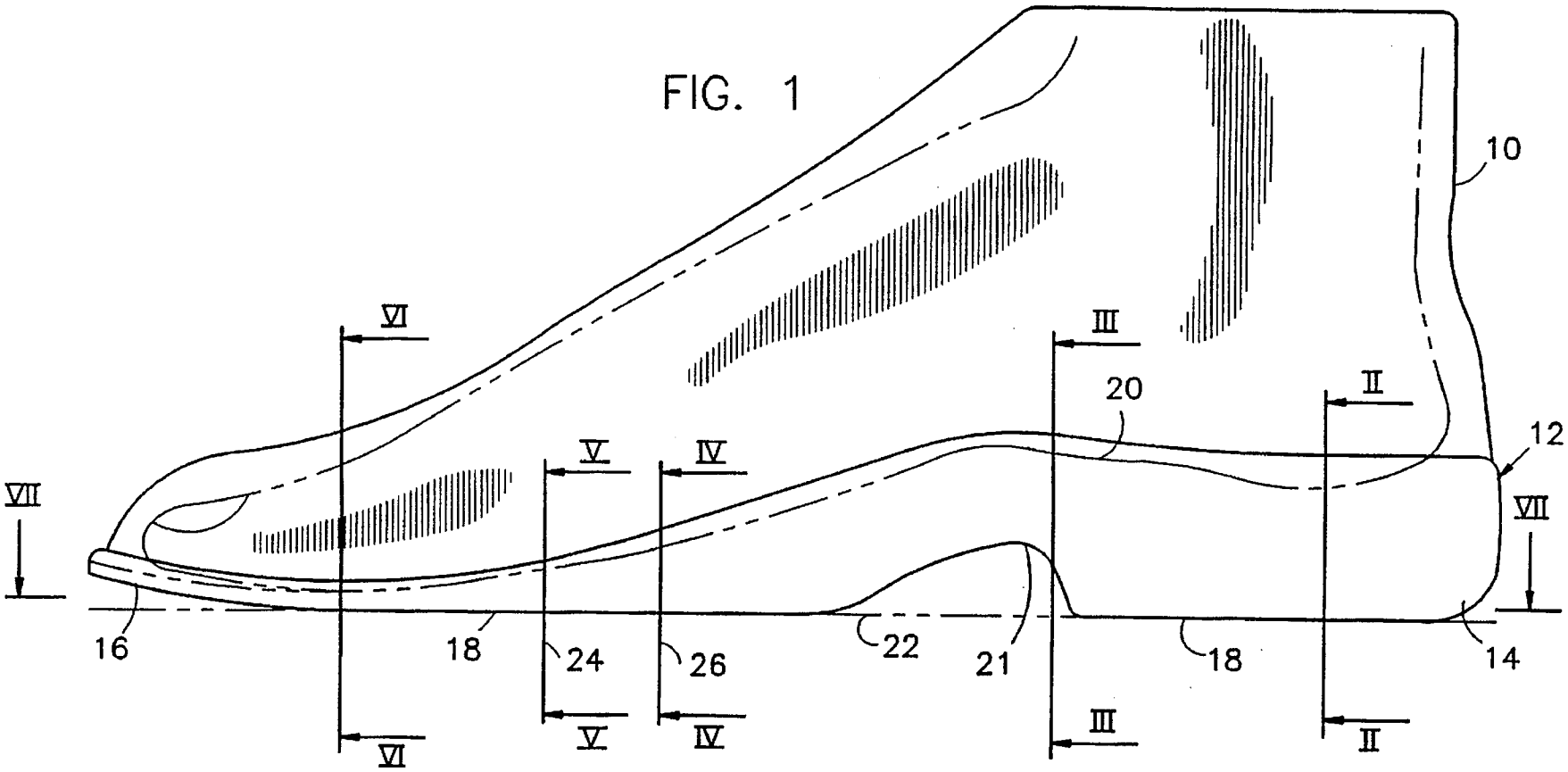
FIG. 1 is a simplified illustration of a shoe constructed and operative in accordance with a preferred embodiment of the present invention.

Reference is now made to FIGS. 1–7, which illustrate a shoe constructed and operative in accordance with a preferred embodiment of the invention. The shoe comprises an upper 10, which is typically formed of leather or alternatively of any other suitable material, and a sole portion 12, which is typically molded of a resilient plastic material, or alternatively of any other suitable material.

Preferably the sole portion is formed with one or more, and most preferably all of the following novel structural features which greatly enhance user comfort and are shown to reduce tibial strain:

I. Foot support surface in the heel portion of the shoe has transverse curvature to match the natural curvature of the heel and to provide ample room for the heel;

II. Hindfoot portion of foot support surface is shaped to maintain a slight varus alignment of the hindfoot with respect to the axis of the tibia;

III. Foot support surface is shaped to shift load of the user rearwardly of the line of the metatarsal heads;

IV. Foot support surface along the line of the metatarsal heads is shaped to maintain a slight valgus alignment of the forefoot with respect to the axis of the tibia;

V. Foot support surface is shaped to allow toes to plantarflex as well as dorsiflex.

The foregoing listed features will now be described in greater detail with respect to FIGS. 1–7.

Sole portion 12 is formed with a heel region 14 and a forward region 16, each having an engagement surface 18. The upper part of the sole portion 12 defines a foot support surface 20. The engagement surfaces 18 of the heel region 14 and of the forward region 16, which are the surfaces which engage a walking surface, are both preferably generally flat and are separated by an arch recess 21.

For ease in description, the shoe is considered as extending along a longitudinal axis 22 and has a length along longitudinal axis 22. As in conventional shoes, metatarsal head line 24 is located forward of the rear of the shoe at a distance approximately equal to ⅔ of the length.

Figure 2:
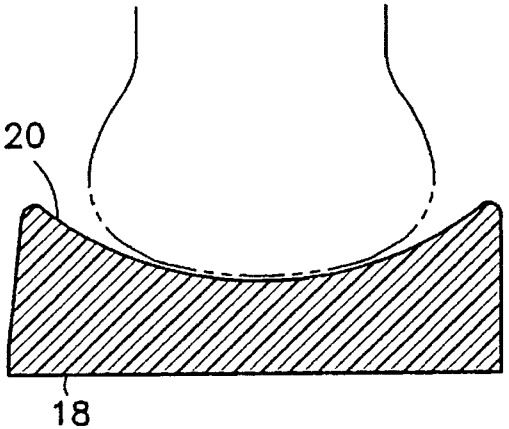
FIGS. 2, 3, 4, 5, 6 and 7 are sectional illustrations taken along respective lines II—II, III—III, IV—IV, V—V, VI—VI and VII—VII of FIG. 1.

In accordance with a preferred embodiment of the present invention, the shoe is constructed such that the foot support surface 20 at the heel region 14 is curved at least in a plane perpendicular to longitudinal axis 22, as seen in FIG. 2. The curvature is preferably generally symmetric and confirms to the natural curvature of a wearer's heel. Ample room is provided on both sides of the heel to provide comfort for the wearer.

Figure 3:
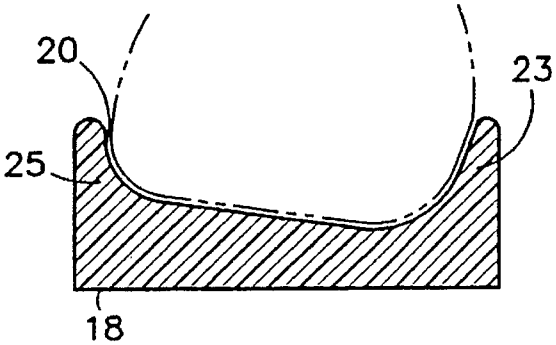

Further in accordance with a preferred embodiment of the present invention, and as seen in FIG. 3, the hindfoot portion of the shoe is constructed such that the lateral side 23 is slightly lowered and the medial side 25 is slightly elevated. This construction maintains a slight varus alignment of the hindfoot with respect to the tibia axis.

As is known in the art, in conventional shoes, a significant portion of the load on the human foot is borne by the metatarsal heads. In accordance with a preferred embodiment of the invention, the shoe is constructed such that this portion of the load is not distributed along metatarsal line 24, but rather along a line indicated by reference numeral 26 which is located rearwardly of the metatarsal line 24 and is preferably displaced rearwardly therefrom along axis 22 by approximately one centimeter.

Figure 4:
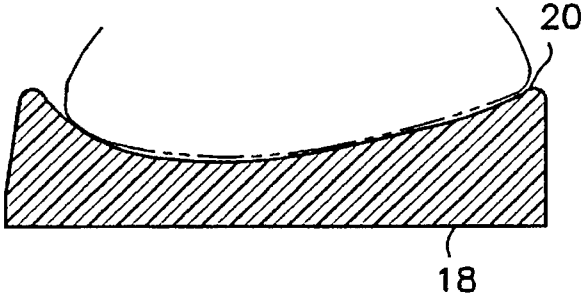

FIG. 4 illustrates the cross-section of the shoe along the load line 26, perpendicular to the longitudinal axis 22. It is seen that the foot support surface 20 is curved non-symmetrically along the load line 26.

Figure 5:
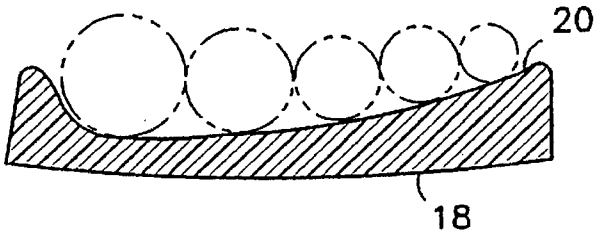

Reference is now made to FIG. 5, which illustrates the cross-section of the shoe along the metatarsal line 24, perpendicular to the longitudinal axis 22. It is seen that the foot support surface 20 is curved non-symmetrically along the metatarsal line 24, and that the first metatarsal is lower than the fifth metatarsal. This construction maintains a slight valgus alignment of the forefoot with respect to the tibia axis.

Figure 6:
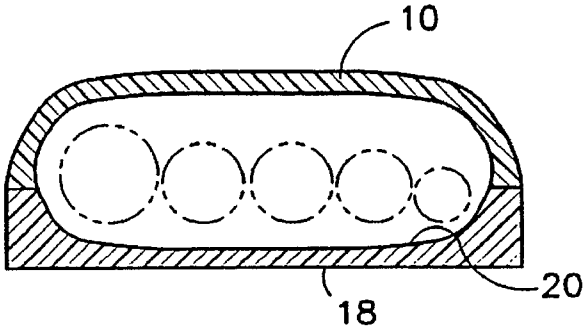

Reference is now made to FIG. 6, which illustrates the cross-section of the shoe along the toes. It is seen that there is a gap between the toes and upper 10 and between the toes and support surface 20. This allows the toes to plantarflex as well as dorsiflex, which improves the comfort of the wearer.

Figure 7:
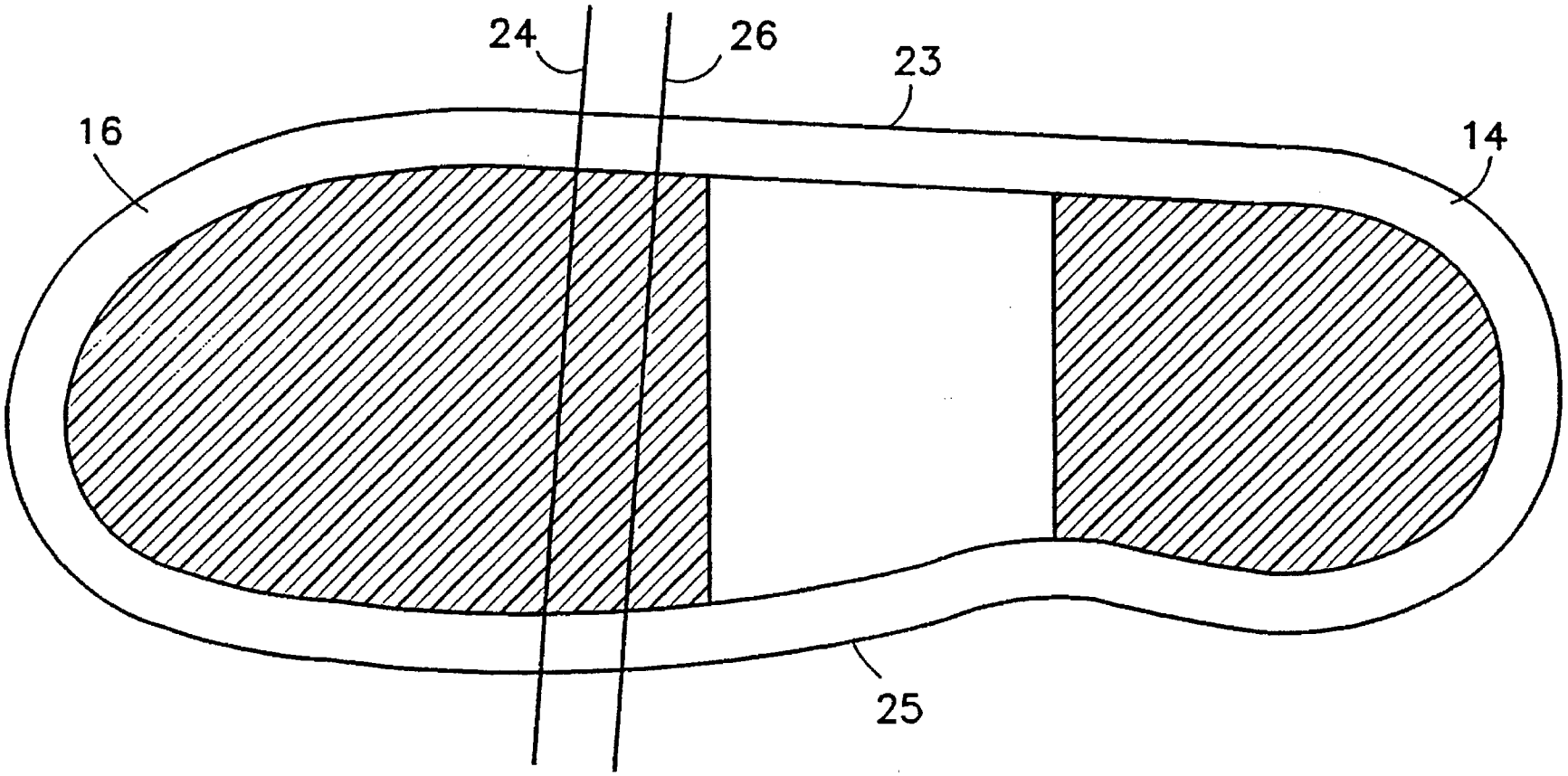
Figure 8:
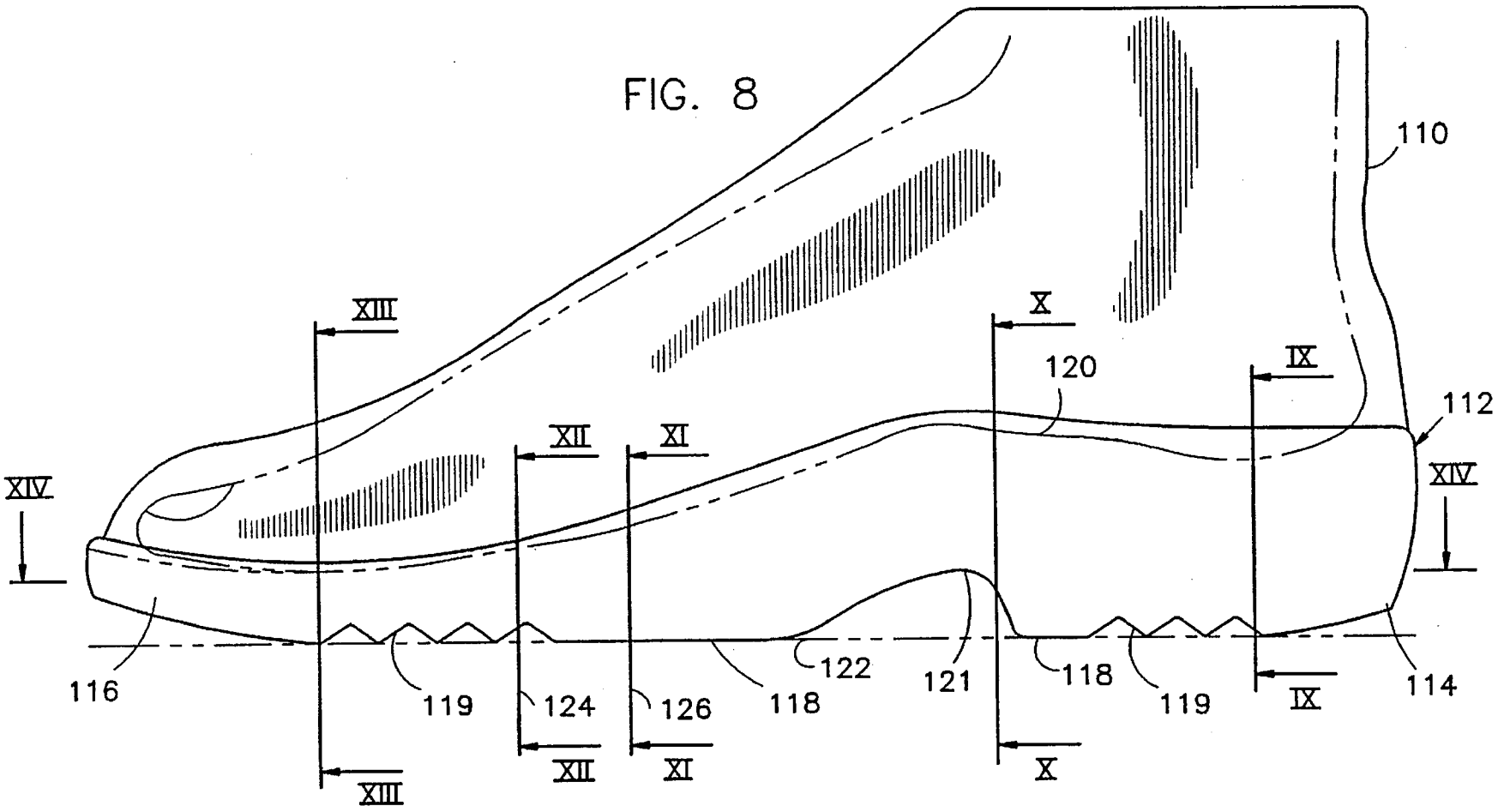
FIG. 8 is a simplified illustration of an infantry boot constructed and operative in accordance with a preferred embodiment of the present invention.

Reference is now made to FIG. 7, in which is seen that the lateral side 23 of the shoe is preferably substantially noncurved, while the medial side 25 is preferably curved. This construction aids in proper placement of the toes, and tends to eliminate medial side pressure on the first metatarsal.

Reference is now made to FIGS. 8–14, which illustrate an infantry boot constructed and operative in accordance with a preferred embodiment of the invention. The boot comprises an upper 110, which is typically formed of leather or alternatively of any other suitable material, and a sole portion 112, which is typically molded of a resilient plastic material, or alternatively of any other suitable material.

Preferably the sole portion is formed with one or more, and most preferably all of the following novel structural features which greatly enhance user comfort and are shown to reduce tibial strain:

I. Foot support surface in the heel portion of the shoe has transverse curvature to match the natural curvature of the heel and to provide ample room for the heel;

II. Hindfoot portion of foot support surface is shaped to maintain a slight varus alignment of the hindfoot with respect to the axis of the tibia;

III. Foot support surface is shaped to shift load of the user rearwardly of the line of the metatarsal heads;

IV. Foot support surface along the line of the metatarsal heads is shaped to maintain a slight valgus alignment of the forefoot with respect to the axis of the tibia;

V. Foot support surface is shaped to allow toes to plantarflex as well as dorsiflex.

The foregoing listed features will now be described in greater detail with respect to FIGS. 8–14.

Sole portion 112 is formed with a heel region 114 and a forward region 116, each having an engagement surface 118. The upper part of the sole portion 112 defines a foot support surface 120. The engagement surfaces 118 of the heel region 114 and of the forward region 116, which are the surfaces which engage a walking surface, are both preferably generally flat and are separated by an arch recess 121. The sole portion 112 may include ground surface gripping protrusions 119.

It will be appreciated that the thickness of the sole portion 112 may be relatively large such as may be found in conventional infantry boots.

For ease in description, the shoe is considered as extending along a longitudinal axis 122 and has a length along longitudinal axis 122. As in conventional shoes, metatarsal head line 124 is located forward of the rear of the shoe at a distance approximately equal to ⅔ of the length.

Figure 9:
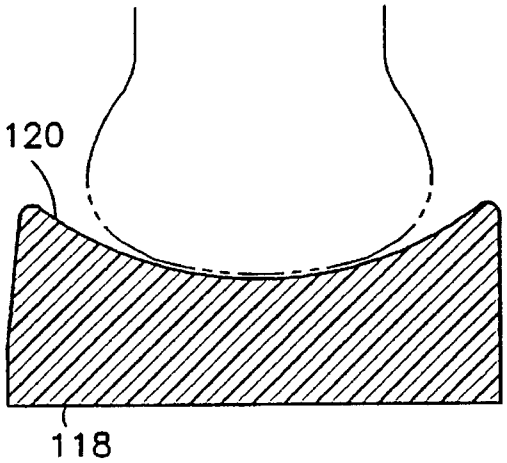
FIGS. 9, 10, 11, 12, 13 and 14 are sectional illustrations taken along respective lines IX—IX, X—X, XI—XI, XII—XII, XIII—XIII and XIV—XIV of FIG. 8.

In accordance with a preferred embodiment of the present invention, the shoe is constructed such that the foot support surface 120 at the heel region 114 is curved at least in a plane perpendicular to longitudinal axis 122, as seen in FIG. 9. The curvature is preferably generally symmetric and confirms to the natural curvature of a wearer's heel. Ample room is provided on both sides of the heel to provide comfort for the wearer.

Figure 10:
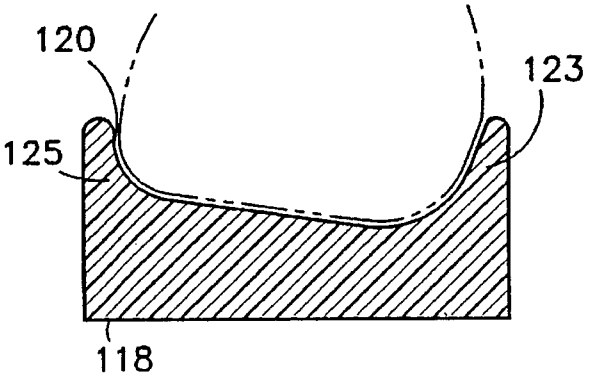

Further in accordance with a preferred embodiment of the present invention, and as seen in FIG. 10, the hindfoot portion of the shoe is constructed such that the lateral side 123 is slightly lowered and the medial side 125 is slightly elevated. This construction maintains a slight varus alignment of the hindfoot with respect to the tibia axis.

As is known in the art, in conventional shoes, a significant portion of the load on the human foot is borne by the metatarsal heads. In accordance with a preferred embodiment of the invention, the shoe is constructed such that this portion of the load is not distributed along metatarsal line 124, but rather along a line indicated by reference numeral 126 which is located rearwardly of the metatarsal line 124 and is preferably displaced rearwardly therefrom along axis 122 by approximately one centimeter.

Figure 11:
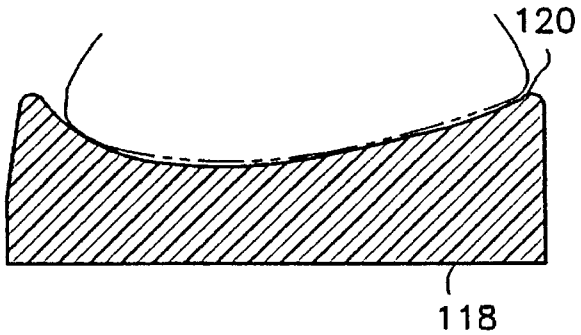

FIG. 11 illustrates the cross-section of the shoe along the load line 126, perpendicular to the longitudinal axis 122. It is seen that the foot support surface 120 is curved non-symmetrically along the load line 126.

Figure 12:
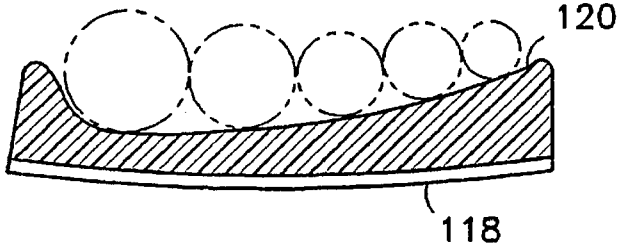

Reference is now made to FIG. 12, which illustrates the cross-section of the shoe along the metatarsal line 124, perpendicular to the longitudinal axis 122. It is seen that the foot support surface 120 is curved non-symmetrically along the metatarsal line 124, and that the first metatarsal is lower than the fifth metatarsal. This construction maintains a slight valgus alignment of the forefoot with respect to the tibia axis.

Figure 13:
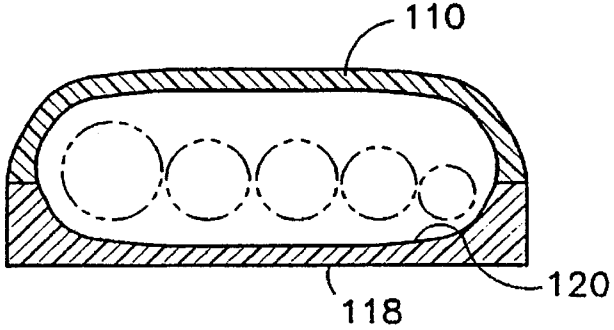

Reference is now made to FIG. 13, which illustrates the cross-section of the shoe along the toes. It is seen that there is a gap between the toes and upper 110 and between the toes and support surface 120. This allows the toes to plantarflex as well as dorsiflex, which improves the comfort of the wearer.

Figure 14:
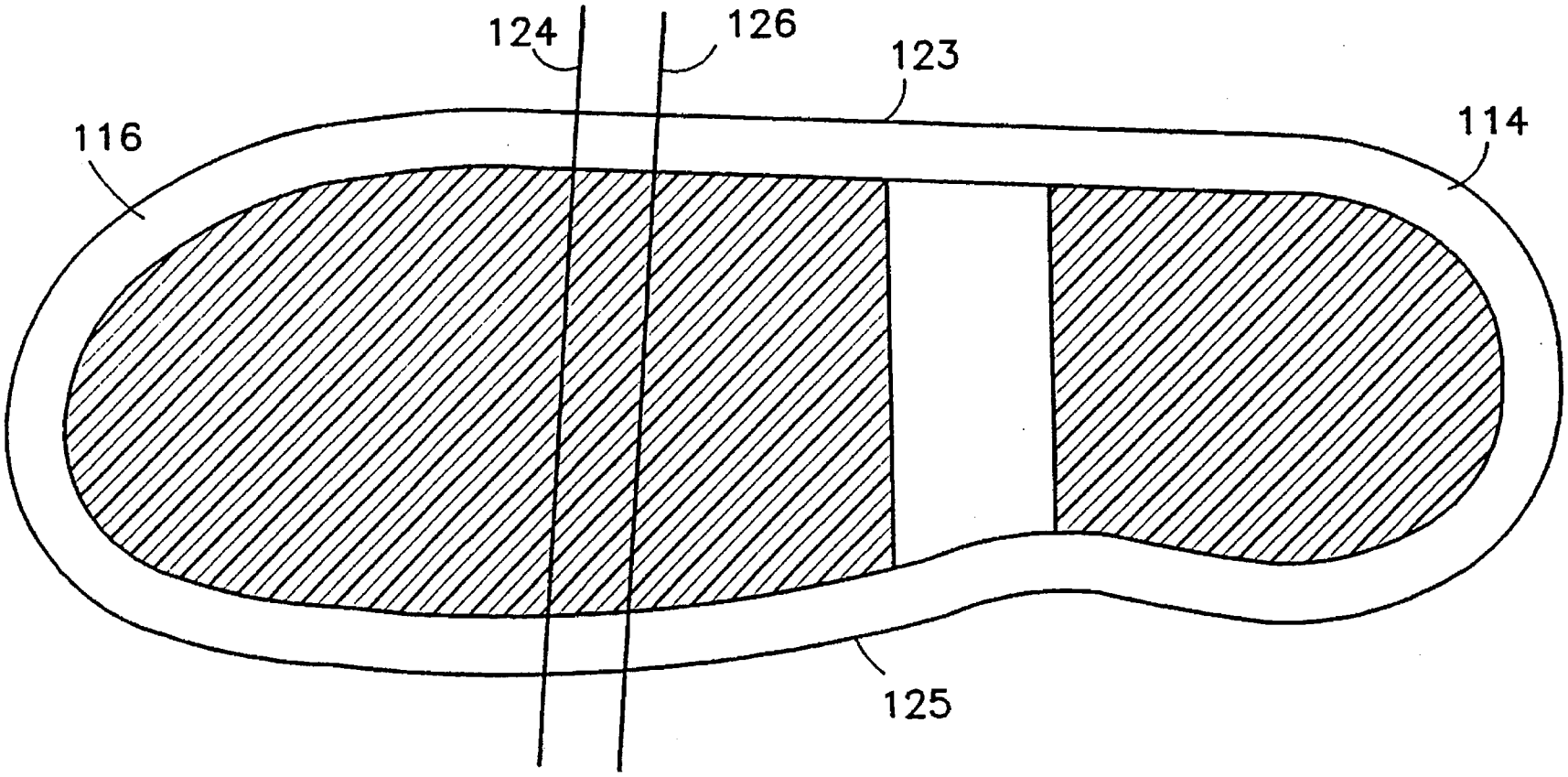

Reference is now made to FIG. 14, in which is seen that the lateral side 123 of the shoe is preferably substantially non-curved, while the medial side 125 is preferably curved. This construction aids in proper placement of the toes, and tends to eliminate medial side pressure on the first metatarsal.

The boot of FIGS. 8–14 has been subjected to in vivo scientific testing by Professor C. Milgrom, Department of Orthopedics, Hadassah Hospital, Jerusalem, Israel. Various tibial strains were measured by bonding two non-stacked rosette strain gauges, one above the other, on the posterior border of the medial side of the midshaft of the right tibia of Professor Milgrom. The tibial strains were measured for five different pairs of shoes while running at a speed of 3 miles per hour on a treadmill. Tibial strains were also measured by telemetry during jogging in three different types of shoes. In both series of tests, the shoe identified as Zohar Infantry Boot is in fact the boot of FIGS. 8–14. The summary of results and table of measurements on which the summary is based are appended hereto as Appendix A.

It is appreciated that a set of orthotics may be provided for use with the shoe of any of FIGS. 1–14. The set preferably comprises three to five different orthotics one of which may be selected by a user to enhance his comfort.

It will be appreciated by persons skilled in the art that the present invention is not limited by what has been particularly shown and described hereinabove. The invention is intended to include variations and modifications of that described hereinabove which are free of the prior art. References to shoes are intended to include boots and other footwear. The scope of the invention is defined only by the claims which follow:

APPENDIX A

Title

In Vivo Measurement of the Effect of Shoe Gear on Human Tibial Strains Recorded from Rosette Strain Gauges Mounted on the Midshaft Tibia during Dynamic Loading

Hypotheses/Purpose

Different shoe gear may effect the magnitude, direction and rate of the principal strains produced in the middle third of the human tibia during treadmill walking.

Conclusions/Significance

Statistically significant differences ($p<0.05$) exist between shoe types as to principal strain, shear strain and principal strain rate at the posterior border of the medial side of the midshaft tibia during treadmill walking. Shoe gear therefore may effect stress fracture incidence at this site.

Summary of Methods, Results

The experimental protocol was approved by the human rights committee and conducted on one of the members of the research team, a 49 year old male in physically fit condition. Under local anesthesia in the operating room, 2 non stacked rosette strain gauges (MicroMeasurements EA06-015RJ120) were bonded, one above the other on the posterior border of the medial side of the mid shaft of the right tibia of the subject. Exiting wires were strain relieved and connected to an external junction box which was taped to the calf. Cable leads were used to connect the junction box to a data acquisition box which fed information into an IBM 350 Thinkpad for data recording and analysis on a customized strain analysis program designed to collect and analyze 4 seconds of data according to principal strain, material axis strain, shear strain, angle of principal strain and principal strain rate. Recording was done from the distal strain gauge with the proximal gauge serving as a backup in the event of distal strain gauge failure. Prior to the experiment the subject "broke in" all the shoes to be used for the experiment. Recording for each of the shoes worn [Rockport ProWalker, New Balance 900 NBX running shoe, standard light weight infantry boot, double layered sole infantry beet, and an experimental infantry boot (Zohar)] were done on a treadmill at a speed of 3 miles/hour after an initial one minute warm up period of walking. No pain was experienced by the subject during the experiment and at the end of data recording strain gauges were removed under local anesthesia in the operating room and found to be unequivocally bonded to the tibia. Results (mean+S.D.in microstrains):

| | TREADMILL WALKING | | | | |
|---|---|---|---|---|---|
| | SHOES | | | | |
| STRAIN | Rockport Walking Shoes | New Balance 900 Running Shoes | Light Infantry Boots | 2 Layer Infantry Boots | Zohar Infantry Boots |
| Principal Compresssive ϵ | −518.67 (20.42) | −474.67 (17.61) | −438.67 (20.29) | −465.67 (11.09) | −391.00* (28.33) |
| Axial ϵ | −57.33 (17.13) | −324.67 (12.04) | −251.67 (9.98) | −244.67 (2.87) | −157.60* (54.17) |

*Statistically significant difference by ANOVA

| Shoes | Principal Strain | Material Axis Strain | Shear Strain | Angle of Prin. Strain | Principal Strain Rate |
|---|---|---|---|---|---|
| Rockport Pro Walker | −518.33 (25.58) | −287.33 (21.55) | 925.67 (39.63) | −15.00 (1.73) | 2849.00 (147.42) |
| New Bal. 900 Run. Shoes | −474.00 (21.0) | −324.67 (14.74) | 757.00 (58.62) | −22.67 (0.58) | 3144.33 (135.82) |
| Light Infantry Boot | −438.00 (24.27) | −251.33 (11.68) | 814.67 (43.43) | −19.33 (1.15) | 2645.67 (797.41) |
| 2 Layer | −465.00 | −244.67 | 900.00 | −18.33 | 4436.00 |

-continued

| | | | | | |
|---|---|---|---|---|---|
| Infantry Boot | (14.11) | (3.51) | (29.61) | (0.58) | (222.99) |
| Zohar | −390.33 | −247.33 | 891.33 | −16.67 | 2220.00 |
| Infantry Boot | (34.59) | (40.55) | (69.06) | (3.06) | (656.43) |

In this experiment the magnitude of the principal tibial strains found during treadmill walking corresponds to that described by Lanyon et al in the only previous human in vivo tibial strain gauge experiment. The current experiment indicates that statistically significant differences exist between shoe types as to principal strain, shear strain and principal strain rate at the site of measurement. This anatomical site is of clinical importance because it corresponds to the most prevalent area of tibial stress fractures in military and athletic trainees. Overall the Zohar infantry boot had the lowest tibial principal strain and principal strain rate. This experiment indicates that proper selection of shoe type has the potential of lowering tibial strains.

MOBILE STRAIN RECORDINGS
Running

| | SHOES | | |
|---|---|---|---|
| STRAIN | New Balance NBX 900 | Zohar Infantry Boots | Light Infantry Boots |
| Principal Compression $\epsilon$ | −935.26 (77.70) | −759.68* (54.49) | −879.43 (73.37) |
| Principal Tensile $\epsilon$ | 580.89 (60.78) | 532.03* (45.50) | 625.47 (14.99) |
| Shear $\epsilon$ | 1513.63 (132.77) | 1275.99* (85.76) | 1444.03 (141.09) |

*Statistically significant difference by ANOVA

I claim:

1. A shoe having a length and a back, said shoe comprising an upper and a sole portion and defining a foot support surface interior of the shoe and an engagement surface exterior of the shoe, a lateral side of a hindfoot portion of the foot support surface being lower than a medial side thereof, —so as to align a hindfoot of a wearer's foot in varus with respect to a tibia axis of said wearer's foot, and wherein the foot support surface is curved to fit the natural shape of a heel of said wearer's foot, and wherein a metatarsal line is defined in the shoe approximately at a location separated from the back of the shoe by a distance equal to two-thirds of the length of the shoe, a medial side of the foot support surface being lower than a lateral side thereof at the metatarsal line so as to align a forefoot of said wearer's foot in valgus with respect to the tibia axis, and wherein the hindfoot portion of the foot support surface is substantially higher than the metatarsal line, the foot support surface being upwardly facing concave in shape from the hindfoot portion along the length of the shoe and gradually sloping towards the metatarsal line, and wherein the foot support surface further gradually slopes under toes of said wearer's foot such that when said wearer is standing erect, articulate extremities of said toes do not nominally touch said foot support surface, thereby allowing said toes to plantarflex and dorsiflex.

2. A shoe according to claim 1 wherein the foot support surface is upwardly facing concave in shape from the hindfoot portion along the length of the shoe and gradually sloping towards the metatarsal line such that a portion of said wearer's foot is born by a load line on the structure of the foot support surface rearward of the metatarsal line.

3. A shoe according to claim 1 and wherein the load line is displaced rearward of the metatarsal line approximately one centimeter.

* * * * *